United States Patent [19]

Shimura

[11] Patent Number: 4,509,723

[45] Date of Patent: Apr. 9, 1985

[54] PORTABLE HYDRAULIC LIFTING JACK

[75] Inventor: Tatsuo Shimura, Tokyo, Japan

[73] Assignee: Yasui Sangyo Co., Ltd., Fujinomiya, Japan

[21] Appl. No.: 508,580

[22] Filed: Jun. 28, 1983

[51] Int. Cl.[3] ..... F15B 15/18

[52] U.S. Cl. ..... 254/93 H; 92/13.7; 60/479

[58] Field of Search ..... 254/1, 93 H, 93 R; 92/13, 13.7; 60/479; 74/518, 522, 525

[56] References Cited

U.S. PATENT DOCUMENTS

| | | | |
|---|---|---|---|
| 2,092,738 | 9/1937 | Rodgers | 92/13.7 |
| 2,328,483 | 8/1943 | Nilson | 60/479 |
| 2,436,916 | 3/1948 | Copeland | 74/518 |
| 3,530,771 | 9/1970 | Bowman | 60/479 |
| 3,806,091 | 4/1974 | Wride | 60/479 |
| 4,048,800 | 9/1977 | Cancilla | 254/93 H |

*Primary Examiner*—Robert C. Watson

*Attorney, Agent, or Firm*—Lackenbach Siegel Marzullo Presta & Aronson

[57] ABSTRACT

A portable hydraulic lifting jack for automobiles comprising a ram cylinder receiving a ram therein, and a plunger cylinder receiving a plunger therein so that the lift head may be hydraulically lifted as the plunger is pumped by a lever, wherein a socket for receiving the lever for activating the plunger is divided into two parts so that the distance between the fulcrum belonging to one of the two parts of the socket and the working end belonging to the other part may be varied according to the need. Since the stroke of the plunger may be varied for the motion of the lever of the lever over a fixed angle, the lifting jack of this invention may be useful for speeding up the motion of the lift head when there is no or very little load thereon, for reducing the force required to be applied to the free end of the lever when the load on the lift head is heavy, and for allowing the lift head to be lifted fairly quickly even when there is limited space for the motion of the lever, without compromising the compactness of the lifting jack or involving any complication of its mechanical and hydraulic structure.

3 Claims, 3 Drawing Figures

PORTABLE HYDRAULIC LIFTING JACK

Figure 1:
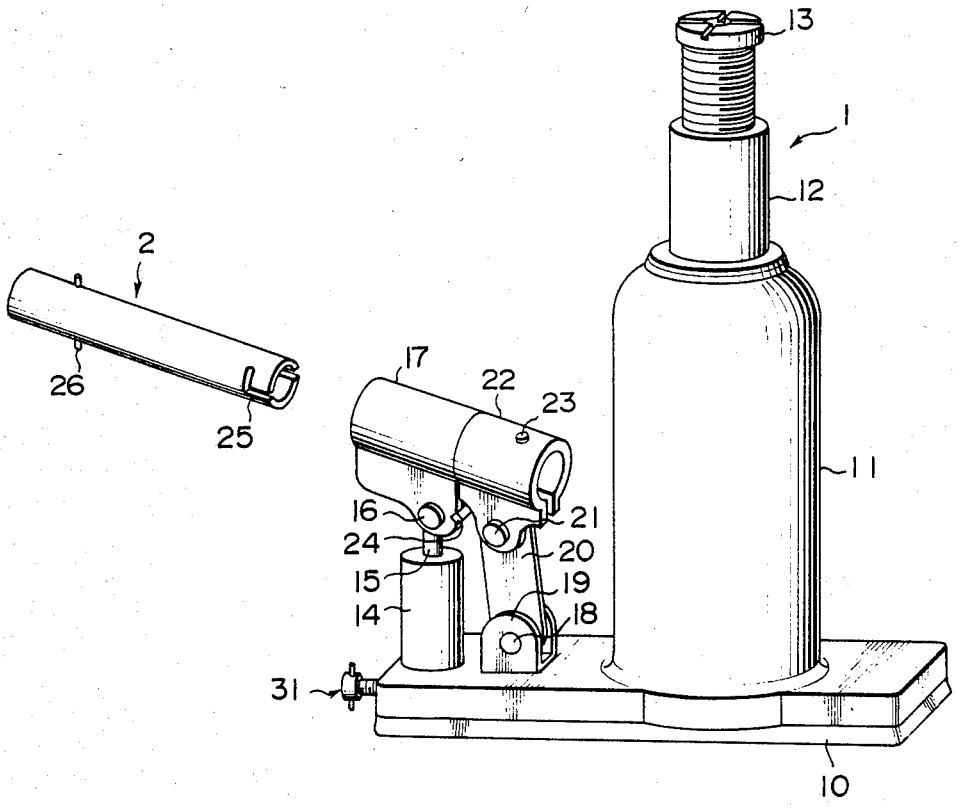

This invention relates to a portable hydraulic lifting jack and in particular to such a lifting jack that is adapted to a wide range of lifting loads.

Generally, a portable hydraulic jack for automobiles are comprised of a plunger for the supply of hydraulic oil from an oil reservoir and a hydraulic ram which actually lifts the load under the pressure from the hydraulic oil created by the plunger. Normally, the cross-sectional area of the ram is several times greater than that of the plunger so that a considerable load may be lifted by the ram while relatively little force is required to be applied to the plunger. The plunger is in turn activated by a lever to further reduce the necessary force and to enhance the convenience of activating the plunger.

In such an arrangement, for a fixed load and a fixed lift, the force necessary for activating the plunger is inversely proportional to the distance the end of the lever at which the force is applied travels. Therefore, in the design of a portable hydraulic lifting jack, the selection of the ratio between the distance of the travel of the free end of the lever and the actual lift of the lifting ram is a very important factor which determines the scope of the application of the particular portable hydraulic lifting jack.

Since the lift characteristics of each portable hydraulic lift are fixed, it is often necessary to equip a garage with two similar portable hydraulic jacks with different lift characteristics. When there is little room for moving the lever for activating a plunger, a portable hydraulic lifting jack with a small ratio of the motion of the lever to that of the lift head is preferred while a portable hydraulic jack with a large ratio is preferred where there is plenty of room for moving the lever since it will reduce the necessary force for activating the plunger and hence facilitates the work.

Also, before the lift head contacts the bottom of the object to be lifted, one has to pump the lever a number of strokes, and much time is wasted even though there is no load on the lift head.

To overcome this difficulty and inconvenience, there has been proposed a portable hydraulic lifting jack provided with two plungers with different cross-sectional areas so that one may select either one of the two plungers according to the particular nature of the current lifting work that has to be done.

However, incorporating two plungers into one lifting jack complicates both the structural and hydraulic make-up of the lifting jack, resulting in reduced reliability, increased cost and difficulty of manufacture.

In view of such inconveniences of conventional portable hydraulic lifting jacks, a primary object of this invention is to provide a portable hydraulic jack which can vary the ratio between its lift and the distance which the free end of the lever must travel for achieving the said lift.

Another object of this invention is to provide a portable hydraulic jack which is compact and yet adapted to lift a very wide range of load under various spatial and load conditions.

According to this invention, such objects are accomplished by providing a portable hydraulic lifting jack for automobiles comprising a main body integrally formed with a plunger cylinder and a ram cylinder both in upright orientation, a plunger that is received in the plunger cylinder, a ram that is received in the ram cylinder, a two-piece socket for receiving a lever for activating the plunger therein with one piece of the socket pivoted to a fixed part of the main body and the other piece of the socket pivoted to the upper end of the plunger so that the distance between the two pieces of the socket may be varied.

Figure 3:
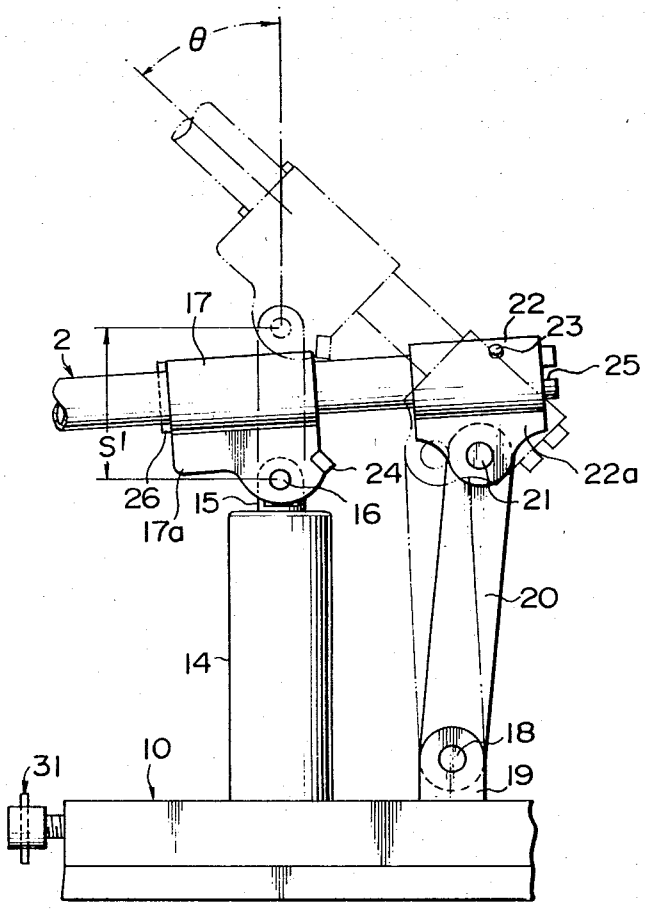
Figure 2:
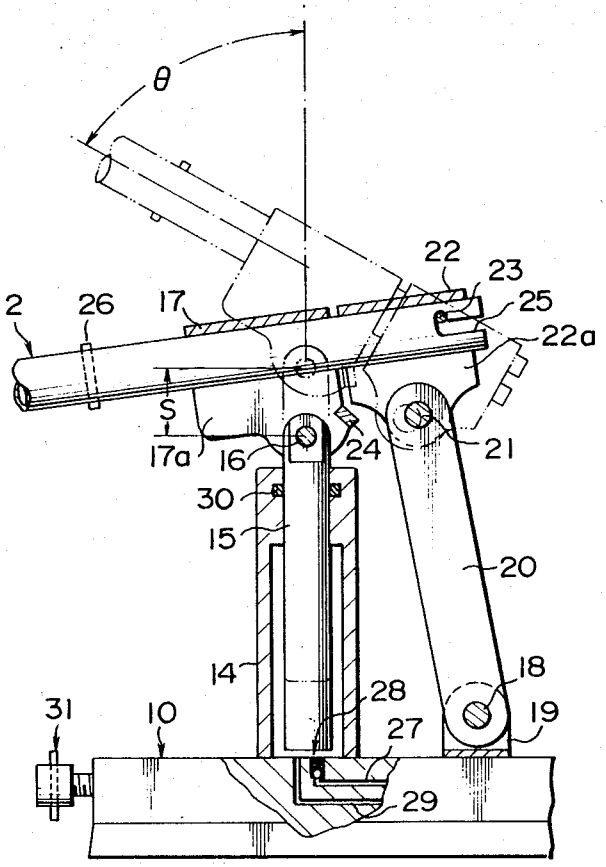

Other objects and advantages of this invention will become better understood through a consideration of the following description taken in conjunction with the accompanying drawings, in which:

FIG. 1 is a perspective view of a portable hydraulic lifting jack according to this invention; and FIGS. 2 and 3 show in detail the structure of the two-piece socket shown in FIG. 1 and how it can vary the ratio of the stroke of the lever to that of the plunger.

In FIG. 1, numeral 1 generally denotes a portable hydraulic lifting jack according to this invention. This lifting jack 1 is mainly comprised of a ram cylinder 11 which receives a ram 12 therein so that a lift head 13 threadably mounted on top of the ram 12 may be used to lift an object such as an automobile.

The necessary hydraulic pressure is generated in a plunger cylinder 14 which receives a plunger 15 therein so that the pumping motion of the plunger 15 creates an hydraulic pressure which is conveyed through a one-way valve 28 and channels 27 and 29 (FIG. 2) provided in a base 10 supporting both the ram cylinder 11 and the plunger cylinder 14 in upright orientation.

So that the plunger 15 may be manually activated with a lever 2, a lever socket 17 and 22 is pivoted to the base 10 by way of a pin 21 passed through one of the two parts of the socket 22, a link 20 pivoted to the same pin 21, and another pin 18 passed through both the other end of the link 20 and a bracket 19 fixedly secured to the base 10, on one hand, and another part of the socket 17 is pivoted to the upper end of the plunger 15 by way of a pin 16, on the other hand. So far, the structure of this hydraulic lifting jack is conventional.

Now, according to this invention, the socket is actually made of two separate pieces 17 and 22 which may be spaced apart by pushing the lever toward the jack main body until a stopper 26 formed on the lever 2 comes into contact with the external end of the second piece of the socket 17.

A pair of slots 25 formed at the working end of the lever 2 is adapted to receive a pin 23 passed across the first piece of the socket 22 as the lever 2 is pushed into the socket 17 and 22. By twisting the lever 2 clockwise after it is inserted into the socket as far as it can, the working end of the lever 2 becomes engaged with the first piece of the socket 22. The slotted end of the lever 2 may also be used for activating a release valve 31 provided with a head, through which a pin is passed, by turning it in an appropriate direction. Additionally, it is possible to pull out the jack main body from an otherwise unreachable position by engaging the release valve head with the slotted end of the lever.

FIG. 2 illustrates the action of the socket 17 and 22 when the two pieces are close to one another with the pieces contacting one another by way of a stopper 24 attached to the second piece of the socket 22. Since the distance between the fulcrum given by the pin 21 is located in the closest possible position relative to the working end defined by the pin 16 of the plunger 15, the motion of the lever 2 over an angle $\theta$ will result in a plunger stroke denoted by S.

This state of the socket 16 and 22 may be achieved and maintained by pulling the lever 2 toward the operator as he pumps the lever 2.

However, When the lever 2 is pushed toward the jack main body, the two pieces of the socket 17 and 22 becomes separated as shown in FIG. 3, and the motion of the lever 2 over the same angle $\theta$ will produce a greater stroke of the plunger as indicated by S'.

As can be readily seen from the drawings, it is possible to select the distance between the fulcrum and the working end of the lever 2 at will simply by adjusting the pushing or pulling of the lever 2 toward or away from the operator. And it is possible to have the two pieces of the socket 17 and 22 at any intermediate distance.

Thus, it is possible, according to this invention, to make use of the position shown in FIG. 2 so that the lift head 13 may be quickly raised and the state of the socket 17 and 22 can be changed as shown in FIG. 3 so that the operator can lift the object by applying a small force to the lever by virtue of the increase in the distance between the fulcrum and the working end.

Furthermore, the hydraulic lifting jack according to this invention is highly useful when there is very little space for moving the lever by pulling the two pieces of the socket 17 and 22 close to one another so that the motion of the lever 2 over a small angle may produce sufficient hydraulic pressure.

Also when the lift head has not quite reached the bottom of an object which is to be lifted, one may speed up the motion of the lift head 13 by achieving the state of the socket 17 and 22 shown in FIG. 3, and, when the lift head has contacted the bottom of the object, one may resort to the state of the socket 17 and 22 as shown in FIG. 2 so that the operator may handle the lever 2 without any undue difficulty.

This invention is highly advantageous since it is able to handle a wide range of load conditions while keeping the force required to move the lever 2 within a reasonable range on the one hand, and on the other hand allows the lift head 13 to be quickly raised even when there is very little space to move the lever 2.

The above described embodiment of this invention is to be considered in all respects as illustrative and not restrictive, the scope of the intention being indicated by the appended claims rather than by the foregoing description, and all changes which come within the meaning and range of equivalence of the claims therefore are intended to be embraced therein.

What is claimed is:

1. A lever activated portable hydraulic lifting jack of relatively compact size for automobiles or the like, comprising:

a main body supporting a plunger cylinder and a ram cylinder in upright orientation, said jack being provided in said main body with a release valve having a rotatable bolt head activated by a slotted end provided in said lever;

a plunger receivable in said plunger cylinder;

a ram receivable in said rom cylinder; and a two-piece socket comprising a first piece and a second piece for slidably receiving a lever therethrough for activating said plunger, said first piece being pivoted to the main body and being provided with a pin for engageably receiving grooves provided in the forward end of said lever;

said second piece being pivoted to the upper end of said plunger so that the distance between said two pieces of said socket is adjustable, and the second piece of the socket freely receives said lever until the second piece comes into contact with a stopper provided in said lever at a predetermined distance from said slotted end of said lever;

whereby said jack is adapted to lift a wide range of loads without any rotation of said lever and whereby the ratio of the stroke of said lever to that of said plunger is very depending upon the separation of said socket pieces by said lever.

2. A portable hydraulic lifting jack for automobiles as defined in claim 1, wherein a contact stopper is provided on the second piece of the socket where it comes into contact with the first piece of the socket.

3. A portable hydraulic lifting jack for automobiles as defined in claim 1, wherein said first piece is pivoted to said fixed part of said main body by means of a link having pivot points at opposite ends thereof, respectively connected to said main body and to said first piece.

* * * * *